US007870703B1

(12) United States Patent
Sorkin

(10) Patent No.: US 7,870,703 B1
(45) Date of Patent: Jan. 18, 2011

(54) UPPER BEAM SLAB BOLSTER FOR USE IN CONSTRUCTION

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 226 days.

(21) Appl. No.: 12/349,389

(22) Filed: Jan. 6, 2009

(51) Int. Cl.
*E04C 5/16* (2006.01)

(52) U.S. Cl. ..... 52/687; 52/677; 52/689; 52/680; 52/686; D25/199; D8/354

(58) Field of Classification Search ..... 52/633, 52/677, 680, 681, 687, 689; D25/199; D9/354
See application file for complete search history.

(56) References Cited

U.S. PATENT DOCUMENTS 3,655,162 A * 4/1972 Shoemaker ..... 249/219.2
5,664,390 A * 9/1997 Sorkin ..... 52/687
D445,668 S * 7/2001 Hills, Sr. ..... D8/354
6,772,571 B1 * 8/2004 Sorkin ..... 52/688
6,775,954 B1 * 8/2004 Sorkin ..... 52/686
6,948,291 B2 * 9/2005 Haslem et al. ..... 52/677
7,108,453 B2 * 9/2006 Harris ..... 404/135
7,284,354 B1 * 10/2007 Sorkin ..... 52/687
D571,189 S * 6/2008 Verelli et al. ..... D8/354
7,497,059 B2 * 3/2009 Bennett ..... 52/677
2009/0165420 A1 * 7/2009 Pfeffer et al. ..... 52/677

* cited by examiner

*Primary Examiner*—Terrell McKinnon
*Assistant Examiner*—Alp Akbasli
(74) *Attorney, Agent, or Firm*—Egbert Law Offices PLLC

(57) ABSTRACT

A bolster for use in construction has a beam, a pair of spaced apart foot members, a first plurality of leg members on one side of the beam, and a second plurality of leg members on an opposite side of the beam. The first plurality of leg members are connected at one end to the beam and at the opposite end to one of the pair of spaced apart foot members. The second plurality of leg members are connected at one end to the beam and at the opposite end to the other of the pair of spaced apart foot members. The beam, pair of spaced apart foot members and first and second pluralities of leg members are integrally formed together of a polymeric material. Multiple lengths of bolster may be joined together in a snap-fit engagement.

16 Claims, 4 Drawing Sheets

UPPER BEAM SLAB BOLSTER FOR USE IN CONSTRUCTION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to bolsters that are used in construction activities for the support of post-tension cables, rebars or mesh. More particularly, the present invention relates to upper beam bolsters that are designed for support on underlying layers of mesh and rebar or on slab-on-grade surfaces. Additionally, the present invention relates to upper beam bolsters formed integrally together of a polymeric material.

2. Description of Related Art

Including Information Disclosed Under 37 CFR 1.97 and 37 CFR 1.98.

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding. These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck. Additionally, the configuration of this Conac bolster allows for easy deformation. It is very difficult and time consuming to join lengths of the Conac bolster together. This plastic bolster is often broken, collapsed, or tipped over in actual use. The base of such a bolster has only a very small area of contact with the deck. As such, these plastic bolsters lack the strength and ability to withstand the loads imparted to them.

U.S. Pat. No. 5,664,390, issued on Sep. 9, 1997 to the present inventor, describes a bolster for use in construction. This bolster has a plurality of leg members arranged in parallel relationship and a beam integrally formed with the plurality of leg members and extending across the plurality of leg members. Each of the plurality of leg members has a foot for contacting the underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. This bolster is of a type for stapling and fixed attachment to an underlying deck. However, under certain circumstances, it would be desirable to be able to use these bolsters for "upper beam" purposes. Upper beam bolsters are often used upon the top of mesh or layers of strands. The upper beam bolsters are commonly used in highway construction where multiple layers of steel are laid out. Under other circumstances, a widened or flat base is required for slab-on-grade construction. The relatively small and narrow feet would sink into sand or dirt if the bolsters of U.S. Pat. No. 5,664,390 were used for "upper beam" purposes. In other circumstances, upper beam slab bolsters are used on corrugating steel decking so as to be in flat surface-to-surface contact with such steel flat surfaces. As such, a need developed so as to allow the bolster of U.S. Pat. No. 5,664,390 to be properly adapted for upper beam bolster purposes.

U.S. Pat. No. 6,775,954, issued on Aug. 17, 2004 to the present inventor, describes such a bolster properly adapted for upper beam bolster purposes. The bolster has a plurality of leg members arranged in generally parallel spaced relationship to each other, a beam integrally formed with the plurality of leg members and extending transversely across the leg members, a first plate affixed to one side of the plurality of leg members and a second plate affixed to an opposite side of the plurality of leg members. Each of the plates has a generally flat bottom surface. A clip is provided on the plates for fixedly attaching the plates to respective feet of the leg members. While the article associated with U.S. Pat. No. 6,775,954 proved successful, connecting the plates with the feet of the leg members is a labor-intensive process. As such, a need has developed for an upper beam slab bolster which does not require assembly.

U.S. Pat. No. 6,772,571, issued on Aug. 10, 2004 to the present inventor, teaches a bolster for use in construction that has a plurality of leg members arranged in a generally parallel spaced relationship, a beam integrally formed with the plurality of leg members which extends transversely across the plurality of leg members, and a plate affixed to the bottom of the plurality of leg members. The plate has a generally flat bottom surface. The plate has at least one clip formed on the top surface receiving a foot associated with at least one of the leg members.

U.S. Pat. No. 7,284,354, issued on Oct. 23, 2007 to the present inventor, describes a bolster for use in construction. The bolster has a beam, a first plurality of leg members on one side of the beam, a second plurality of leg members on an opposite side of the beam, a first plate having a receptacle on one side thereof and a second plate having a receptacle on one side. The receptacle of the first plate receives a portion of the first plurality of leg members therein. The receptacle of the second plate receives a portion of the second plurality of leg members. The receptacles have a generally C-shaped cross section for resiliently contacting surfaces of the respective leg members. The plate is integrally formed of an extruded polymeric material.

U.S. Pat. No. 7,373,764, issued on May 20, 2008 to the present inventor teaches a similar extruded upper beam slab bolster for use in construction. The bolster has a beam, a first plurality of leg members on one side of the beam, a second plurality of leg members on an opposite side of the beam, and a plate having a first receptacle on one side and a second receptacle on the opposite side. The first receptacle receives a portion of the first plurality of leg members therein. The second receptacle receives a portion of the second plurality of leg members therein. The plate is integrally formed of an extruded polymeric material.

It is an object of the present invention to provide an upper beam slab bolster that is corrosion-proof and relatively inexpensive.

It is another object of the present invention to provide an upper beam bolster that can withstand the forces imparted to it.

It is a further object of the present invention to provide an upper beam slab bolster that is integrally formed together through injection molding processes.

It is still a further object of the present invention to provide an upper beam bolster that is easy to manufacture and easy to use.

It is yet another object of the present invention to provide an upper beam bolster that is stackable and easily transported.

It is another object of the present invention to provide upper beam bolsters that are easily attachable to each other.

These and other objects and advantages of the present invention will become apparent from a reading of the attached specification and appended claims.

BRIEF SUMMARY OF THE INVENTION

The present invention is a bolster for use in construction having abeam, a pair of spaced apart foot members, a plurality of first leg members arranged in spaced relationship on one side of the beam which are connected at one end to one of the pair of spaced apart foot members and at the opposite end to the beam, and a plurality of second leg members arranged in spaced relationship on the opposite side of the beam which are connected at one end to another of the pair of spaced apart foot members and at the opposite end to the beam.

In the present invention, each of the first and second leg members converge upwardly toward the beam. The first and second leg members have an upper end joined at the beam so as to define a planar surface thereacross. The first and second leg members have a wider portion adjacent to the beam and a narrower portion adjacent to the foot members.

The beam and the pair foot members have a connecting means for joining the beam and pair of spaced apart foot members to a beam and pair of spaced apart foot members of an adjacent bolster. The bolsters are joined in a generally linear arrangement. The connecting means on the beam has a downwardly opening slot and a downwardly facing key member at one end of the beam, and an upwardly opening slot and an upwardly facing key member on the opposite end of the beam.

The connecting means on the foot members have a downwardly facing slot and a downwardly facing key member on one end of each of the feet, and an upwardly facing slot and an upwardly facing key member on the opposite end of each of the feet. The downwardly facing slot has a wall defining an angle acute to vertical. The upwardly facing key member has a vertical wall.

In the present invention, the bolster has an interior shape suitable for residing in a nested relationship over an exterior surface of another bolster.

The present invention is also an upper beam slab bolster having a first upper beam slab bolster and a second upper beam slab bolster. Each of the first and second upper beam slab bolsters have abeam, a pair of spaced apart foot members, a plurality of first leg members arranged in spaced relationship on one side of the beam which are connected to one of the pair of spaced apart foot members and to the beam, and a second plurality of leg members arranged in spaced relationship on the opposite side of the beam which are connected to the other of the pair of spaced apart foot members and to the beam. One end of the first upper beam slab bolster snappingly engages with one end of the second upper beam slab bolster.

DETAILED DESCRIPTION OF THE INVENTION

Figure 1:
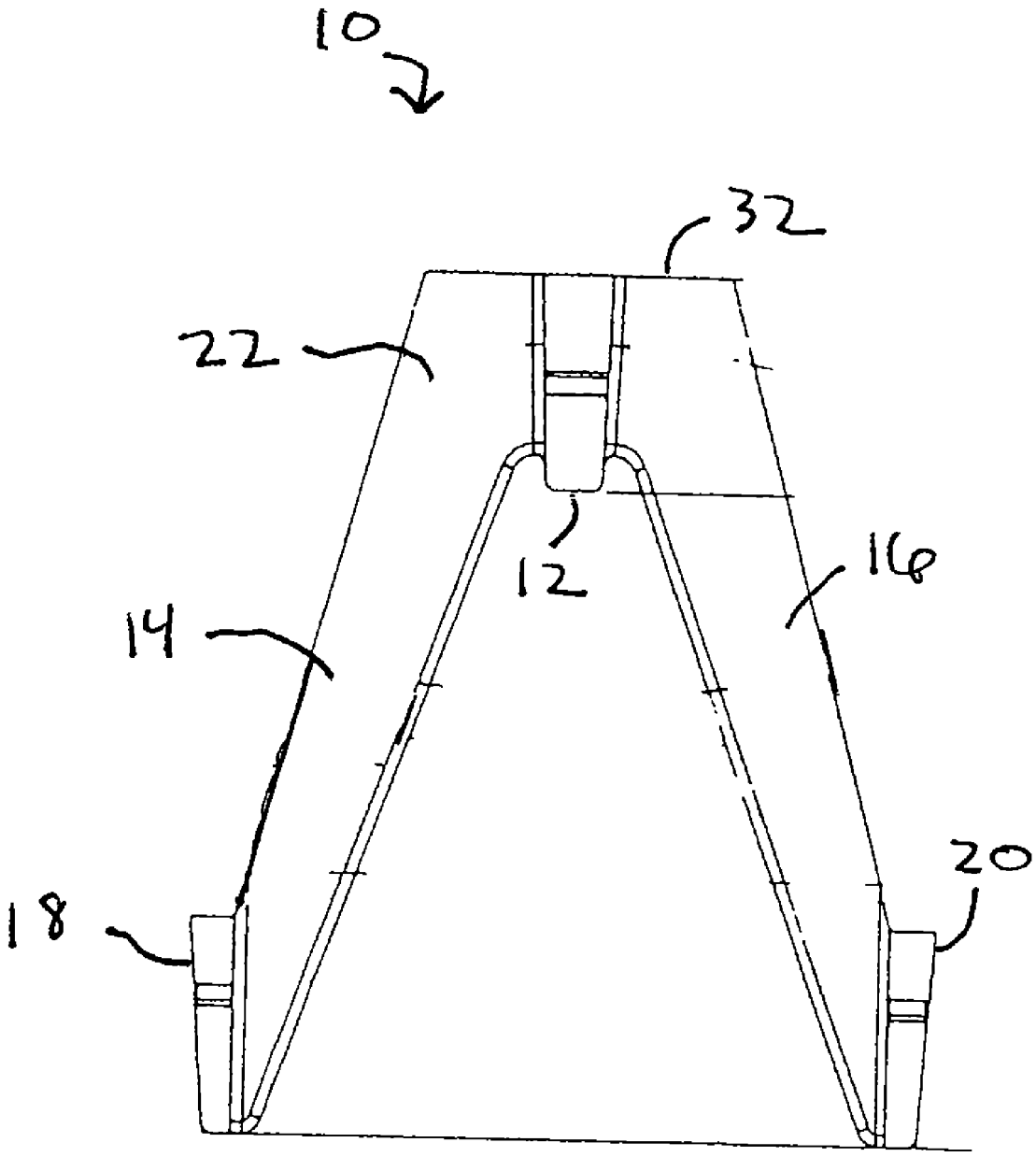
FIG. 1 is an end view of the upper beam slab bolster of the present invention

Referring to FIG. 1, there is shown an end view of the upper beam slab bolster 10 of the present invention. The beam bolster 10 of the present invention includes a beam 12, a first leg 14, a first foot 18, a second leg 16 and a second foot 20. The first leg 14 is connected to the first foot 18, and the second leg 16 is connected to the second foot 20. The first leg 14 and the second leg 16 converge toward and are connected to the beam 12, forming an inverted V-shape. The first leg 14 and the second leg 16 are formed so as to have a wider portion adjacent to the beam 12 and a narrow portion adjacent to the feet 18 and 20. This tapered configuration is important due to the different coefficients of thermal expansion of concrete and the polymeric material with which the bolster 10 is constructed. The connection of the first leg 14 and the second leg 16 forms a planar surface 22 with a horizontal top surface 32. The horizontal top surface 32 is flush with the top surface of the beam 12. Each of the parts of the bolster 10 are formed integrally together of a polymeric material through an injection molding process. This method of manufacturing the bolsters produces inexpensive units which are substantially stronger than the wire bolsters.

Figure 2:
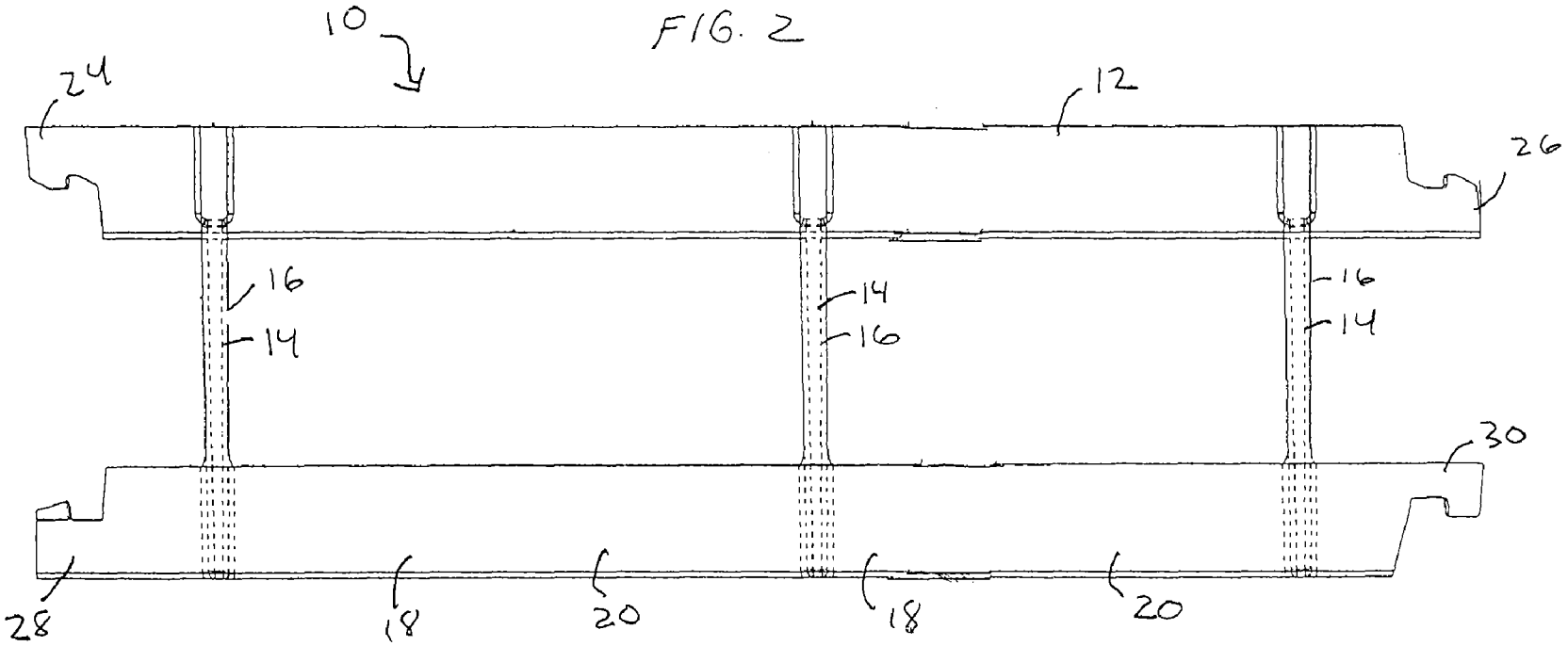
FIG. 2 is a side view of the upper beam slab bolster of the present invention

FIG. 2 shows a side view of the upper beam slab bolster 10 of the present invention. When used in construction, numerous lengths of the beam bolster 10 are connected end-to-end to reach the desired length. As shown in FIG. 2, the beam bolster 10 has three sets of legs 14 and 16 which are arranged in spaced relationship along a length of the bolster 10. Three sets of legs is appropriate for a 2.5 foot length of the bolster 10, however different lengths of the bolster 10 may have greater or fewer sets of legs 14 and 16.

As can be seen in FIG. 2, the opposite ends of the beam bolster 10 have different configurations. A first upper connector piece 24 and a first lower connector piece 28 are at one end. A second upper connector piece 26 and a second lower connector piece 30 are at the other end of the bolster 10. Each of the first foot 14 and the second foot 16 have both a first lower connector piece 28 and a second lower connector piece 30. Two lengths of the beam bolster 10 snappingly engage each other so that the first upper connector piece 24 of a first length of beam bolster 10 connects to a second upper connector piece 26 of a second length of beam bolster 10. Similarly, the first lower connector pieces 28 of a first length of beam bolster 10 connect to the second lower connector pieces 30 of the second length of beam bolster 10. Such an arrangement is described in greater detail in FIGS. 3 and 4.

In FIG. 2, it can also be seen that the first foot 18 and the second foot 20 have a generally flat lower surface. Similarly, beam 12 is shown as having a generally flat upper surface. The upper surface of the beam 12 may have a variety of shapes, such as a wave-like shape, to accommodate reinforcing bar or mesh.

Figure 3:
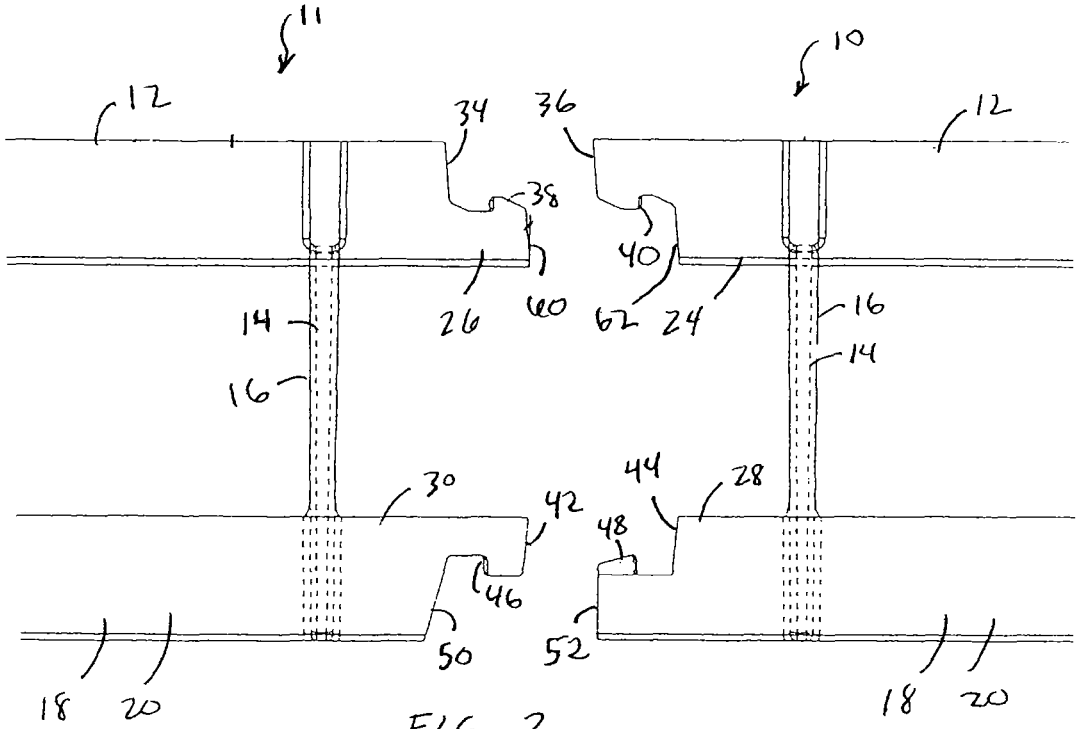
FIG. 3 is an isolated view of two interlocking upper beam slab bolsters.

FIG. 3 shows a first beam bolster length 10 and a second beam bolster length 11. The two lengths of beam bolster are identical. In FIG. 3, it can be seen how the first upper connector piece 24 (shown here on first beam bolster length 10) fits together with the second upper connector piece 26 (shown here on second beam bolster length 11). Similarly, the first lower connector pieces 28 (shown here on first beam bolster length 10) fit together with the second lower connector pieces 30 (shown here on second beam bolster length 11).

First upper connector piece 24 has a slot which opens downwardly and a key member 40. The key member 40 fits within the upwardly opening slot of the second upper connector piece 26. Similarly, the key member 38 of the second upper connector piece 26 fits within the downwardly opening slot of the first connector piece 24. The first and second upper connector pieces 24 and 26 have substantially vertical slot walls 36 and 34, respectively. Similarly, the first and second upper connector pieces 24 and 26 have substantially vertical key member walls 62 and 60, respectively.

First lower connector piece 28 has a slot which opens upwardly. The slot has a substantially vertical slot wall 44, a key member 48 and a vertical key member wall 52. The second lower connector piece 30 has a slot which opens downwardly. The slot has a substantially vertical key member wall 42, a key member 46 and a slot wall 50. The slot wall 50 is not vertical, but rather defines a surface that is at an acute angle to vertical.

Figure 4:
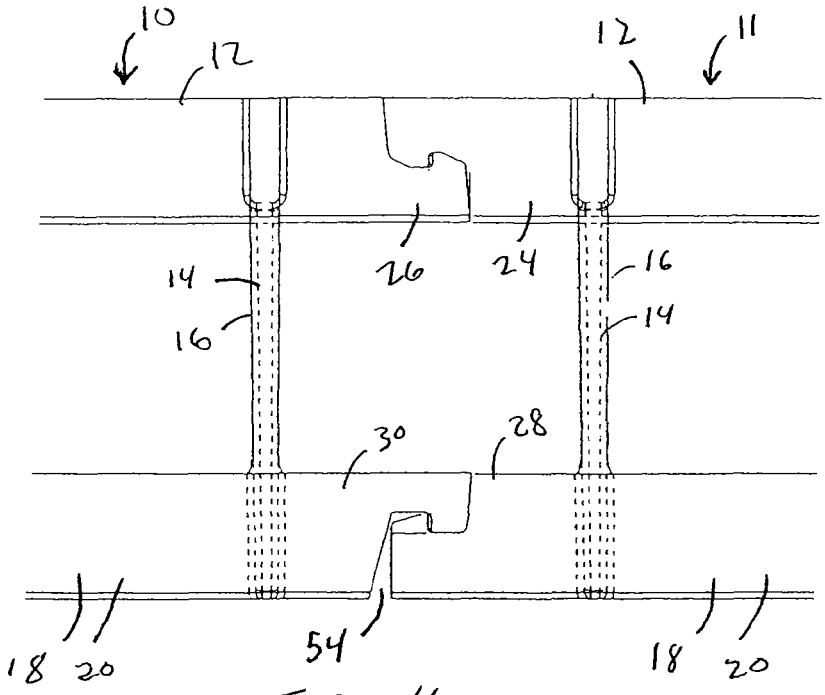
FIG. 4 is an isolated view of two upper beam slab bolsters connected to each other.

Referring to FIG. 4, there is shown the first beam bolster length 10 snappingly engaged with the second beam bolster length 11. The first upper connector piece 24 is flush with the second upper connector piece 26. In contrast, there is an angular gap 54 between the first lower connector piece 28 and the second lower connector piece 30. The angular gap 54 is necessary to effectuate the snap fit of the beam bolsters 10 and 11. When assembling the two lengths of bolster, the second beam bolster length 11 is angled downwardly away from the horizontal. The key member 48 of the first lower connector piece 28 is fitted within the slot of the second lower connector piece 30. Similarly, the key member 38 of the second upper connector piece 26 is fitted within the slot of the first upper connector piece 24. The second beam bolster length 11 is then moved upwardly toward horizontal and the lower connector pieces 28 and 30 snappingly lock into place. The angled key member wall 50 allows for the snapping engagement of the two lengths of bolster.

Figure 5:
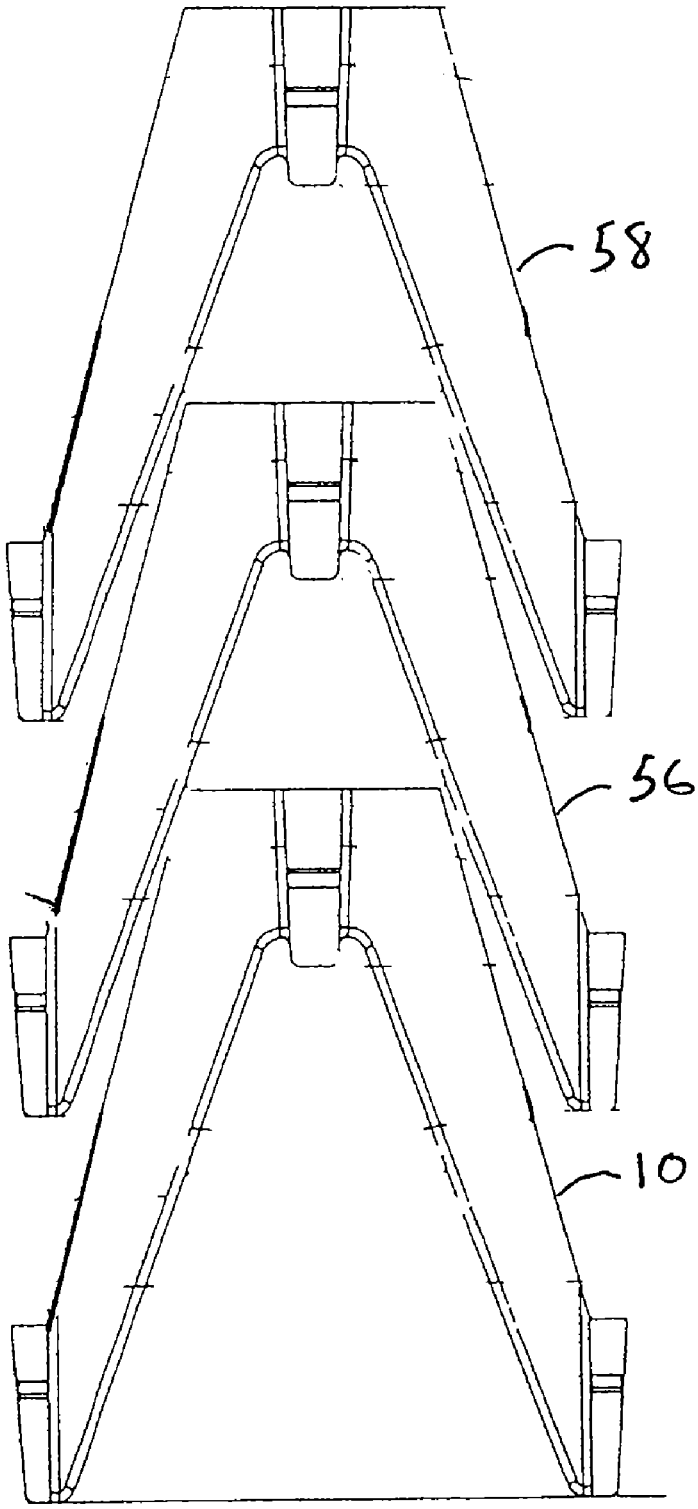
FIG. 5 is a side view showing the nesting ability of the upper beam slab bolsters of the present invention.

Referring to FIG. 5, there is shown the nesting ability of the beam bolster lengths 10, 56 and 58. This is in contrast to many bolsters of the prior art have utilized a horizontal bottom plate to support the bolster, making nesting impossible. The nesting ability of the bolster 10 allows more efficient packaging, shipping and storage.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A bolster for use in construction comprising:

a beam;

a pair of spaced apart foot members;

a plurality of first leg members arranged in spaced relationship on one side of said beam, said plurality of first leg members connected to one of said pair of spaced apart foot members and to said beam;

a plurality of second leg members arranged in spaced relationship on an opposite side of said beam, said second plurality of leg members connected to a another of said pair of spaced apart foot members and said beam, said beam and said pair of spaced apart foot members and said first and second pluralities of leg members being integrally formed together of a polymeric material; and each of said beam and said pair of spaced apart foot members having a connecting means thereon, said connecting means for joining said beam and said pair of spaced apart foot members to a beam and a pair of foot members of an adjacent bolster, said connecting means comprising:

a downwardly facing slot and a downwardly facing key member on one end of each of said pair of spaced apart foot members, said downwardly facing slot having a wall defining an angle acute to vertical; and an upwardly facing slot and an upwardly facing key member on an opposite end of each of said pair of spaced apart foot members, said upwardly facing key member having a vertical wall.

2. The bolster of claim 1, each the first and second leg members converging toward said beam.

3. The bolster of claim 1, the first leg member and the second leg member having an upper end joined at said beam so as to define a planar surface thereacross.

4. The bolster of claim 1, each of said first and second leg members having a wider portion adjacent to said beam and a narrow portion adjacent to said foot members.

5. The bolster of claim 1, said connecting means of said beam comprising:

a downwardly opening slot and a downwardly facing key member on one end of said beam bolster of said bolster; and an upwardly opening slot and an upwardly facing key member on an opposite end of said beam of said bolster.

6. The bolster of claim 1, said bolster having an interior shape suitable for residing in a nested relationship over an exterior surface of another bolster.

7. A bolster for use in construction comprising:

a beam;

a pair of spaced apart foot members, at least one of said beam and said pair of spaced apart foot members having a slot formed at one end thereof a key member formed at an opposite end thereof, said slot being downwardly facing, said key member being upwardly facing;

a plurality of first leg members arranged in spaced relationship on one side of said beam, said plurality of first leg members connected to one of said pair of spaced apart foot members and to said beam; and a plurality of second leg members arranged in spaced relationship on an opposite side of said beam, said second plurality of leg members connected to a second of said pair of spaced apart foot members and said beam.

8. The bolster of claim 7, said slot having an inner wall and an outer wall, said outer wall being generally vertically oriented, said inner wall being oriented at an angle acute to vertical.

9. The bolster of claim 7, said beam and said pair of spaced apart foot members and said first and second pluralities of leg members being integrally formed together of a polymeric material.

10. The bolster of claim 7, each of said first and second leg members having a wider portion adjacent to said beam and a narrow portion adjacent to said foot members.

11. A slab bolster assembly comprising:

a first upper beam slab bolster, said first upper beam slab bolster comprising:

a beam;

a pair of spaced apart foot members;

a plurality of first leg members arranged in spaced relationship on one side of said beam, said plurality of first leg members connected to one of said pair of spaced apart foot members and to said beam; and a plurality of second leg members arranged in spaced relationship on an opposite side of said beam, said second plurality of leg members connected to a second of said pair of spaced apart foot members and to said beam; and a second upper beam slab bolster, said second upper beam slab bolster connected to said first upper beam slab bolster, said second upper beam slab bolster comprising:

a beam;

a pair of spaced apart foot members;

a plurality of first leg members arranged in spaced relationship on one side of said beam of said second upper beam slab bolster, said plurality of first leg members of said second upper beam slab bolster connected to one of said pair of spaced apart foot members of said second upper beam slab bolster and to said beam of said second upper beam slab bolster;

a plurality of second leg members arranged in spaced relationship on an opposite side of said beam of said second upper beam slab bolster, said second plurality of leg members of said second upper beam slab bolster connected to a second of said pair of spaced apart foot members of said second upper beam slab bolster and to said beam of said second upper beam slab bolster; and one end of said first upper beam slab bolster having a slot formed therein, one end of said second upper beam slab bolster having a key member formed thereon, said key member fitting within said slot.

12. The slab bolster assembly of claim 11, one end of said first upper beam slab bolster being snappingly engaged with one end of said second upper beam slab bolster.

13. The slab bolster assembly of claim 11, each of said first upper beam slab bolster and said second upper beam slab bolster being integrally formed together of a polymeric material.

14. The slab bolster assembly of claim 12, said slot of said first upper beam slab bolster being formed on said beam of said first upper beam slab bolster, said key member of said second upper beam slab bolster being formed on said beam of said second upper beam slab bolster.

15. The slab bolster assembly of claim 12, said slot of said first upper beam slab bolster being formed on at least one of said pair of spaced apart foot members of said first upper beam slab bolster, said key member of said second upper beam slab bolster being formed on at least one of said pair of spaced apart foot members of said second upper beam slab bolster.

16. The upper beam slab bolster of claim 11, each of said first and second leg members having a wider portion adjacent to said beam and a narrow portion adjacent to said foot members.

* * * * *